United States Patent [19]

Slattery

[11] Patent Number: 4,913,109

[45] Date of Patent: Apr. 3, 1990

[54] MARINE OUTBOARD DRIVE WITH OIL TANK FILL TUBE

[75] Inventor: Gordon C. Slattery, Omro, Wis.

[73] Assignee: Brunswick Corporation, Skokie, Ill.

[21] Appl. No.: 360,272

[22] Filed: Jun. 2, 1989

[51] Int. Cl.[4] ..... F01M 1/00

[52] U.S. Cl. ..... 123/196 R; 184/105.1

[58] Field of Search ..... 123/73 AD, 196 R; 184/105.1

[56] References Cited

U.S. PATENT DOCUMENTS

| | | | |
|---|---|---|---|
| 4,300,489 | 11/1981 | Perrin | 123/73 AD |
| 4,331,185 | 5/1982 | Rinaldo et al. | 184/105.1 |
| 4,594,970 | 6/1986 | Baars et al. | 123/73 AD |
| 4,800,854 | 1/1989 | Slattery | 123/195 P |

OTHER PUBLICATIONS

Mercury Marine, Brunswick Corp., Quicksilver Parts Catalog, 90-18583, pp. 2, 3, Sep. 1987.

*Primary Examiner*—E. Rollins Cross

*Attorney, Agent, or Firm*—Andrus, Sceales, Starke & Sawall

[57] ABSTRACT

A marine outboard drive unit (10) includes a two-cycle internal combustion engine (14), an oil storage tank (30) storing lubricating oil for the engine, and a fill tube (40) within the engine cowl (24) for filling the oil tank therebelow. The fill tube includes a partitioned (82) upper cup portion (66) vented (76) to the tank and closed by a tactilely hinged cap (68).

24 Claims, 4 Drawing Sheets

MARINE OUTBOARD DRIVE WITH OIL TANK FILL TUBE

BACKGROUND AND SUMMARY

The invention relates to marine outboard drive units with a two-cycle internal combustion engine, and more particularly to a fill tube assembly for filling an oil tank.

In various marine outboard drive units having a two-cycle internal combustion engine, it is desirable to provide an automatic oil-fuel mixing system, eliminating the need to manually pre-mix the oil and fuel. The automatic system draws oil from an oil tank and fuel from a fuel tank, and mixes the oil and fuel in a desired ratio. In other applications, it is desirable to provide oil injection. The present invention provides a fill tube assembly for filling the oil tank.

In the preferred embodiment, the fill tube assembly is mounted within the upper cowl which houses the engine of the marine outboard drive unit. The fill tube is particularly useful in combination with the oil tank of copending application Ser. No. 360,273, filed June 2, 1989 on even date herewith, entitled "Marine Outboard Drive With Oil Tank". The tank is mounted around the driveshaft housing below the cowl. The invention is also useful in combination with the draw tube and indicator assembly of copending application Ser. No. 360,274, filed 6-2-89 on even date herewith, entitled "Marine Outboard Drive With Oil Tank Draw Tube and Indicator", and with the oil pump of copending application Ser. No. 360,265, filed on 6-2-89 even date herewith, entitled "Oil Metering Pump With Air Purge".

DETAILED DESCRIPTION

Figure 1:
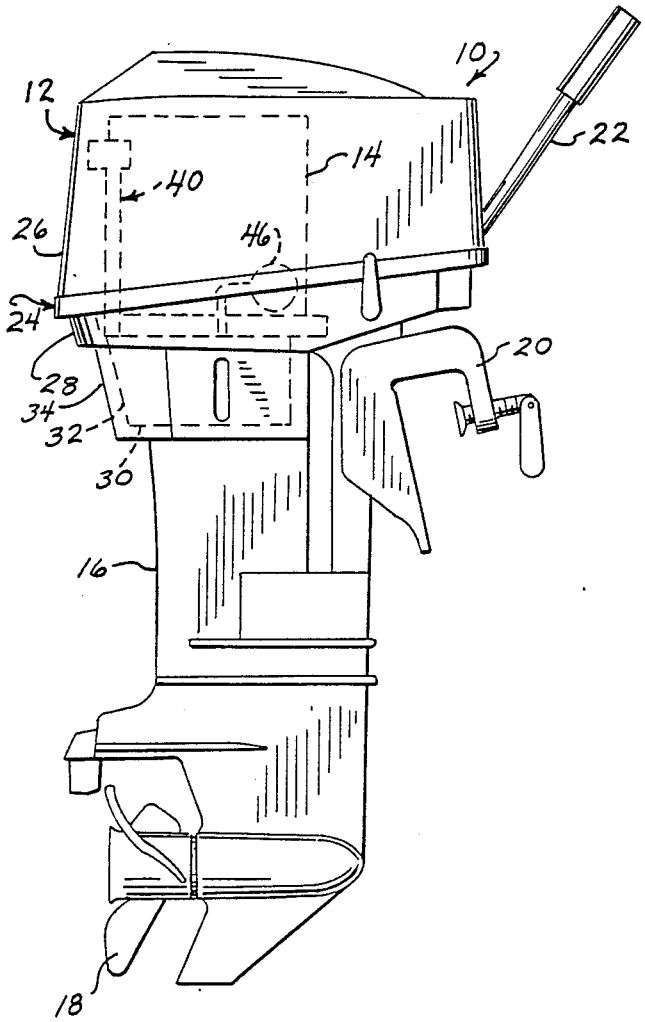
FIG. 1 is a side elevation view of a marine outboard drive unit in accordance with the invention.

FIG. 1 shows a marine outboard drive unit 10 having a powerhead 12 including a two-cycle internal combustion engine 14 and having a lower depending driveshaft housing 16 extending downwardly from the powerhead and having a lower submerged propeller 18. The unit is mounted to the transom of a boat by transom bracket 20, and is steered by tiller handle 22. Cowl 24 encloses engine 14, and includes an upper cowl section 26 and a lower cowl section 28, for example as shown in U.S. Pat. No. 4,800,854, incorporated herein by reference, and in Mercury Marine, Brunswick Corp., Quicksilver Parts Catalog 90-18583, pages 2, 3, Sept. 1987.

A molded plastic oil tank 30 is mounted adjacent driveshaft housing 16 below powerhead 12. Oil tank 30 is the subject of above noted copending application Ser. No. 360273, filed on 6-2-89 even date herewith, entitled "Marine Outboard Drive With Oil Tank". Oil tank 30 has a U-shape when viewed from above, FIG. 2, and extends partially around and conforms to driveshaft housing 16. The bight 32 of the U-shape is aft. A trim cover 34, FIG. 1, extends downwardly from the cowl lower portion 28 and is spaced outwardly from driveshaft housing 16. Oil tank 30 is in the space between trim cover 34 and driveshaft housing 16.

Figure 2:
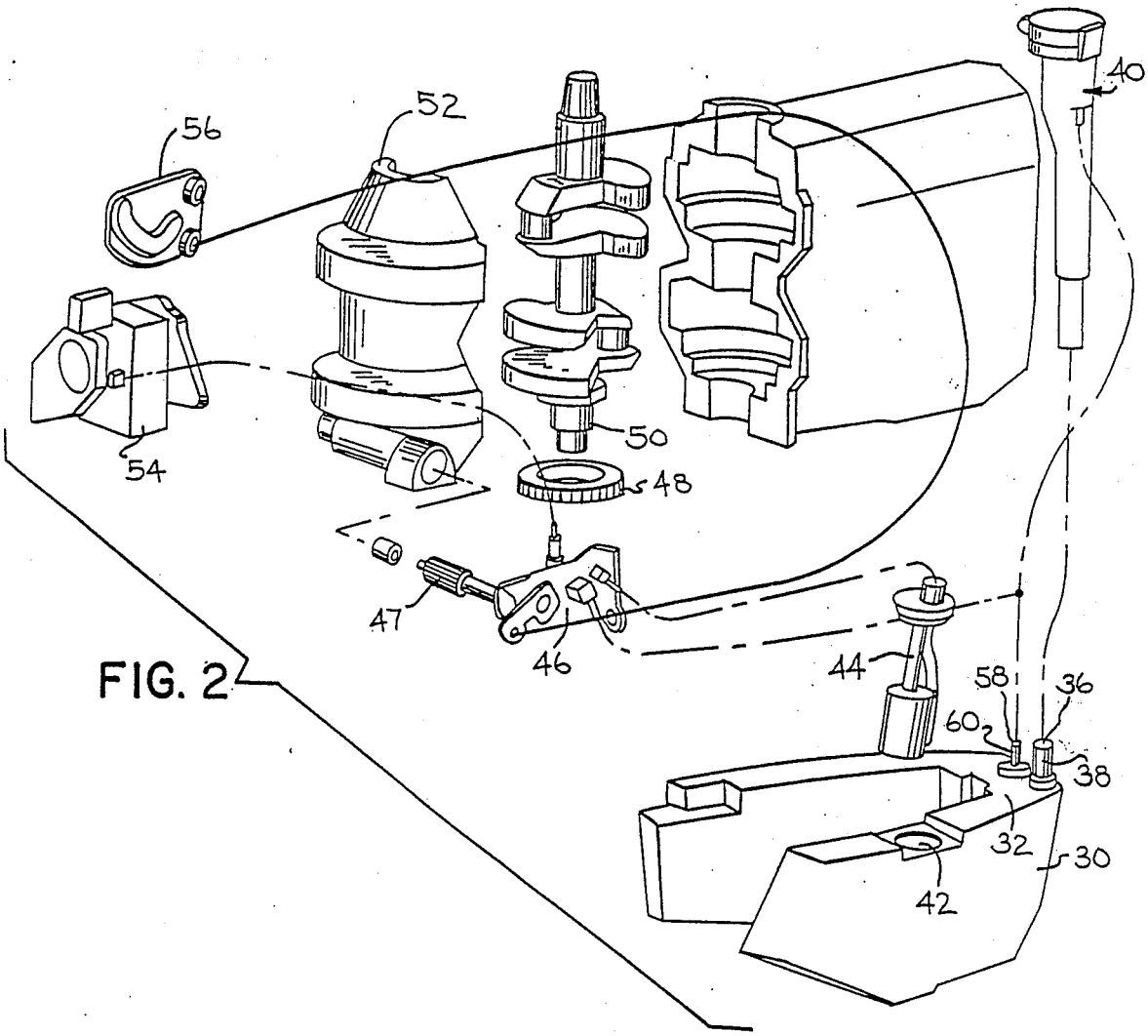
FIG. 2 is a schematic perspective view of an oil-fuel mixing system using the fill tube of the present invention.

Oil tank 30 has a first aperture 36, FIG. 2, with an upstanding fitting 38 for filling the tank with oil from fill tube 40, which is the subject of the present invention. Tank 30 has a second aperture 42 in the top thereof for receiving a draw tube and indicator, assembly 44 for drawing oil from the tank and for indicating oil level in the tank. Assembly 44 is the subject of above noted copending application Ser. No. 360274, filed on 6-2-89 even date herewith, entitled "Marine Outboard Drive With Oil Tank Draw Tube And Indicator". The oil is drawn by an oil pump 46, which is the subject of above noted copending application Ser. No. 360274, filed on 6-2-89 even date herewith, entitled "Oil Metering Pump With Air Purge". Pump 46 has a gear 47 driven by gear 48 on crankshaft 50 in crankcase 52 and pumps oil to carburetor 54 as controlled by throttle 56. Tank 30 has a third aperture 58 with an upstanding fitting 60 providing a vent for the tank and receiving overflow from pump 46.

Figure 3:
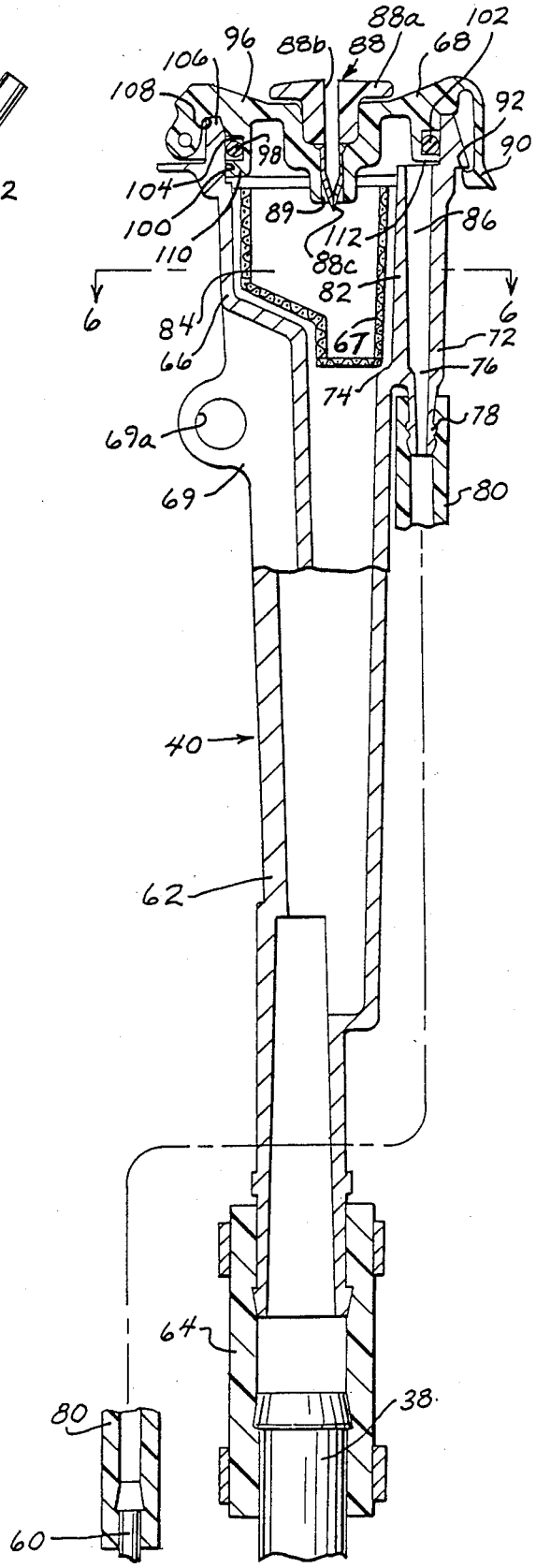
FIG. 3 is an enlarged sectional view of a portion of the structure in FIG. 1.
Figure 7:
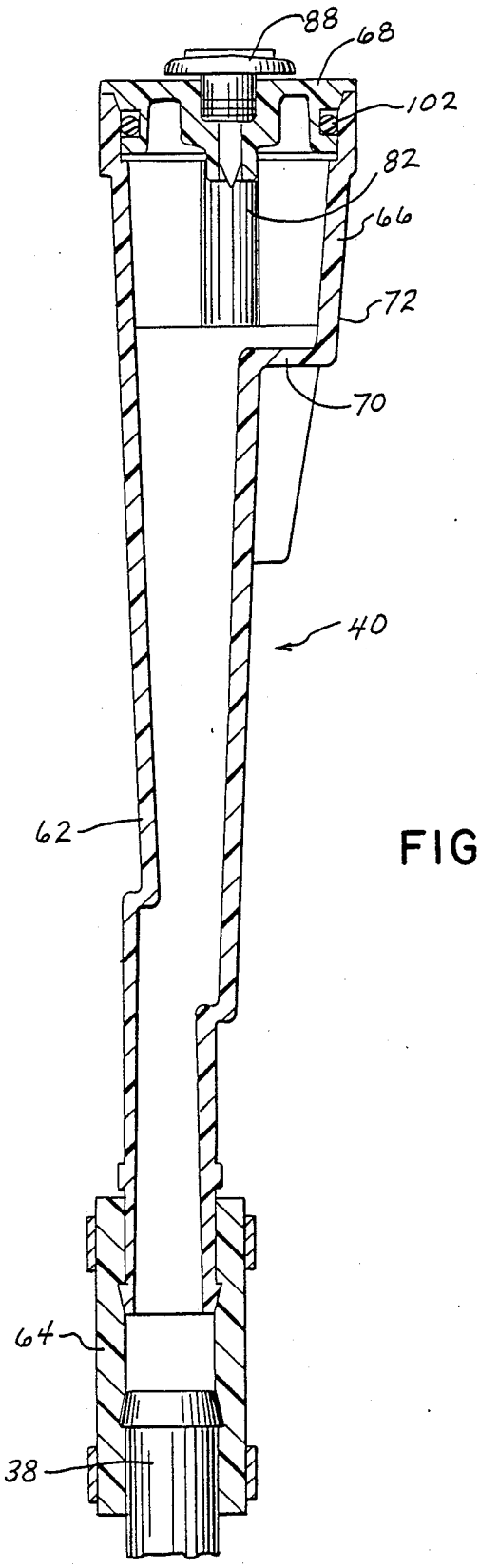
FIG. 7 is a sectional view taken along line 7—7 of FIG. 6.

Fill tube 40, FIGS. 3 and 7, includes a lower tubular portion 62 extending downwardly and connected by flexible hose 64 to fitting 38 of tank 30 to communicate with the latter. Fill tube 40 includes an enlarged upper cup portion 66 of greater diameter than lower tubular portion 62 to facilitate pouring of oil into cup portion 66 to flow downwardly through lower tubular portion 62 into tank 30 at fitting 38, to fill the tank. A filter 67 is provided in cup portion 66. The top of cup portion 66 is closed by an upper cap 68. The exterior of cup portion 66 has an anchor or tab section 69 with an aperture **69*a* therethrough for receiving a bolt to mount the fill tube assembly to engine 14 in cowl 24**.

Figure 6:
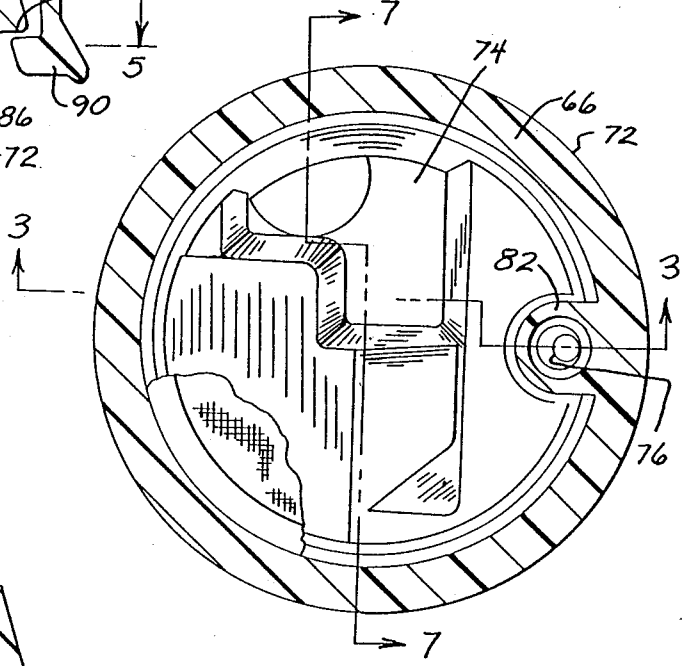
FIG. 6 is a sectional view taken along line 6—6 of FIG. 3.

Upper cup portion 66 of the fill tube has a bottom wall 70, FIG. 7, and a cylindrical sidewall 72 extending upwardly therefrom. Bottom wall. 70 has a first opening 74, FIGS. 3 and 6, communicating with lower tubular portion 62, and a second opening 76 providing a vent opening. Opening 76 is laterally spaced from opening 74 and has a substantially smaller diameter than opening 74. Fitting 78 extends downwardly from bottom wall 70 at vent opening 76, parallel to lower tubular portion 62, and is connected by a flexible hose 80 to fitting 60 of tank 30 to vent the tank to upper cup portion 66 of fill tube 40.

Upper cup portion 66 of the fill tube includes an inner dividing wall 82, FIG. 3, partitioning cup portion 66 into a first section 84 communicating with lower tubular portion 62 through opening 74, and a second section 86 communicating with vent opening 76. Dividing wall 82 is an annular wall, FIG. 6, extending upwardly along the interior surface of cylindrical sidewall 72 of cup portion 66 and has a diameter substantially smaller than the diameter of cup portion 66 defined by cylindrical sidewall 72. Cap 68 includes a pressure relief valve 88 venting the interior of the fill tube including both sections 84 and 86 of upper cup portion 66. Relief valve 88 is provided by an upper cap **88*a* having a central air passage 88*b* communicating with a one-way duckbill valve 88 therebelow in passage 89 in cap 68**.

Figure 4:
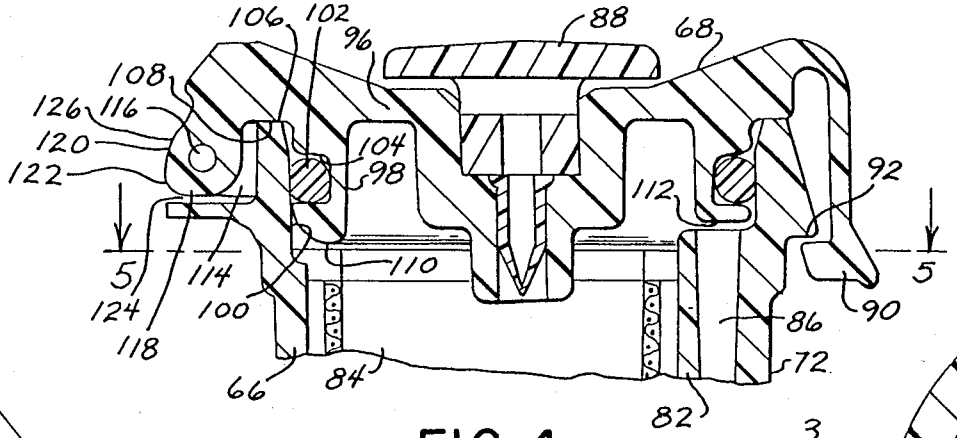
FIG. 4 is an enlarged view of a portion of FIG. 3.
Figure 5:
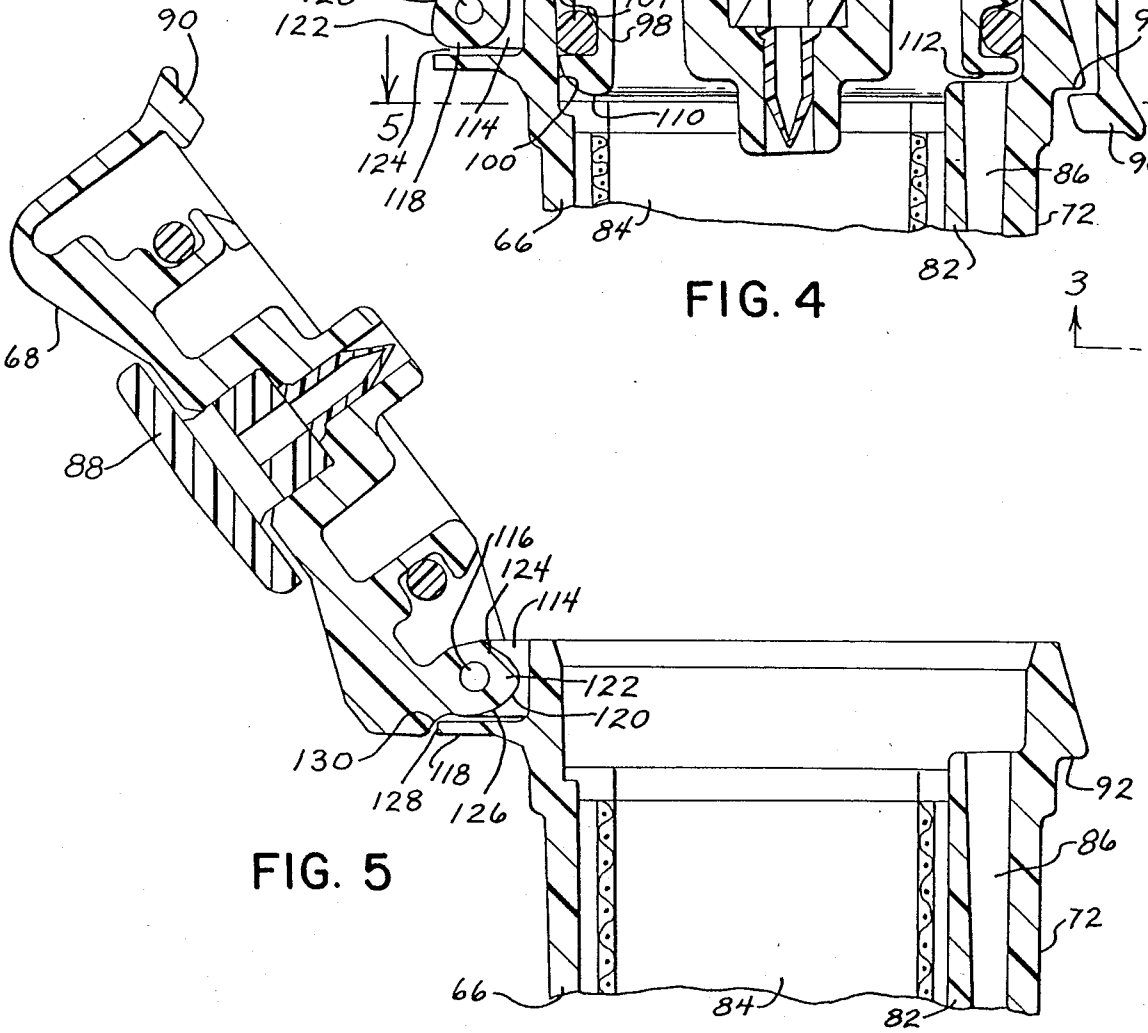
FIG. 5 is an enlarged view of the structure of FIG. 4 showing an alternate position.

Cap 68 is hinged at its left side, FIGS. 3–5, to cup portion 66 of the fill tube, and has a distally opposite side with a snap lock closure finger 90 engaging lip 92 of cup portion 66.. To open the cap, finger 90 is deflected outwardly to allow clearance thereof laterally past lip 92. Cap 68 is hinged to an external surface of the cylindrical sidewall 72 of cup portion 66, and snap lock closure finger 90 of the cap engages the distally opposite external surface of sidewall 72 at lip 92.

Cap 68 has an upper surface 96 and a cylindrical sidewall 98 extending downwardly therefrom and engaging the upper interior surface 100 of cylindrical sidewall 72 in sealing relation. Annular gasket 102 seals the interface between downwardly depending cylindrical sidewall 98 of the cap and upper interior surface 100 of cylindrical sidewall 72. Sidewall 98 has an annular groove 104 therein receiving and retaining gasket 102 such that the gasket is carried by cap 68. Cylindrical sidewall 72 has a top annular surface 106. Top wall 96 of cap 68 has an annular undersurface 108 adjacent and laterally outward of depending sidewall 98 thereof and engaging the top annular surface 106 of cylindrical sidewall 72 of the fill tube in sealing relation upon closure of cap 68, to provide further sealing. The bottom surface 110 of depending sidewall 98 is annular and has a notch 112 formed therein immediately above partition wall 82 and vent section 86 to space the notched portion of depending wall 98 above such vent section and provide communication between sections 86 and 84 through such notch 112.

The fill tube has an upper hinge 114, FIGS. 4 and 5, pivotally mounting cap 68 at pivot pin 116 to upper cup portion 66. A cantilever tab 118 extends laterally leftwardly from the fill tube adjacent and below the pivot axis along pin 116. Cap 68 has a camming surface 120 extending from the pivot axis at pin 116 with an increased radius at portion 122 between reduced radii at portions 124 and 126. Reduced radius portion 124 of camming surface 120 faces cantilever tab 118 in the closed position of the cap, FIG. 4, and may be in engagement with tab 118, or may be slightly spaced above and out of engagement with tab 118 as shown. The other reduced radius portion 126 of camming surface 120 faces cantilever tab 118 in an open position of the cap, FIG. 5, and may be in engagement with tab 118, or may be slightly spaced above and out of engagement with tab 118 as shown. Intermediate increased radius portion 122 of camming surface 120 engages and cammingly deflects cantilever tab 118 during pivoting movement of cap 68 between the closed and open positions. Cantilever tab 118 has a resistance to deflection which is overcome during pivoting movement of the cap. The deflection of tab 118 provides a tactile feel, and also resiliently retains the cap in the open position, FIG. 5. In the preferred embodiment, tab 118 is nondeflected in both the closed position and the open position, FIGS. 4 and 5, respectively. Tab 118 has an outer edge 128 engaged by stop shoulder surface 130 of cap 68 in the open position, FIG. 5, to stop further pivoting movement of cap 68 and limit the travel thereof.

It is recognized that various equivalents, alternatives and modifications are possible within the scope of the appended claims.

I claim:

1. A marine outboard drive unit having a two-cycle internal combustion engine, an oil storage tank mounted to said outboard drive unit and storing lubricating oil for said engine, a fill tube mounted to said outboard drive unit and comprising a lower tubular portion extending downwardly and communicating with said oil tank, an enlarged upper cup portion of greater diameter than said lower tubular portion to facilitate pouring of oil into said cup portion to flow downwardly through said lower tubular portion into said tank to fill the latter, and a cap closing said cup portion.

2. The invention according to claim 1 comprising a flexible hose connecting the bottom of said tubular portion of said fill tube to said tank.

3. The invention according to claim 1 wherein said cup portion of said fill tube has a vent opening, and comprising a hose connected between said tank and said vent opening and venting said tank to said cup portion of said fill tube.

4. The invention according to claim 3 wherein said cup portion includes an inner dividing wall partitioning said cup portion into a first section communicating with said lower tubular portion, and a second section communicating with said vent opening.

5. The invention according to claim 4 wherein said cup portion has a bottom wall and a generally cylindrical sidewall extending upwardly therefrom, said bottom wall having a first opening communicating with said lower tubular portion, and a second opening providing said vent opening, and wherein said inner dividing wall comprises an annular wall extending upwardly along the interior of said cylindrical sidewall of said cup portion and having a diameter substantially smaller than the diameter of said cup portion defined by said cylindrical sidewall.

6. The invention according to claim 5 wherein said second opening in said bottom wall of said cup portion is laterally spaced from said first opening and has a substantially smaller diameter than said first opening.

7. The invention according to claim 6 comprising a fitting extending from said bottom wall of said cup portion at said second opening downwardly and parallel to said lower tubular portion.

8. A marine outboard drive unit having a two-cycle internal combustion engine, an oil storage tank mounted to said outboard drive unit and storing lubricating oil for said engine, a fill tube mounted to said outboard drive unit and extending downwardly and communicating with said oil tank, a cap hinged at one side to said fill tube and having a distally opposite side with a snap lock closure engaging said fill tube to close same.

9. The invention according to claim 8 comprising a pressure relief valve in said cap venting the interior of said fill tube when closed by said cap.

10. The invention according to claim 8 wherein said fill tube includes an upper cylindrical sidewall, and wherein said cap is hinged to an external surface of said sidewall, and said snap lock closure of said cap engages a distally opposite external surface of said sidewall.

11. The invention according to claim 10 wherein said cap has a top wall and a cylindrical sidewall extending downwardly therefrom and engaging the interior surface of said cylindrical sidewall of said fill tube in sealing relation.

12. The invention according to claim 11 comprising an annular gasket sealing the interface between said downwardly depending cylindrical sidewall of said cap and said interior surface of said cylindrical sidewall of said fill tube.

13. The invention according to claim 12 wherein said downwardly depending cylindrical sidewall of said cap has an annular groove therein receiving and retaining said gasket such that said gasket is carried by said cap.

14. The invention according to claim 11 wherein said cylindrical sidewall of said fill tube has a top annular surface, and said top wall of said cap has an annular undersurface adjacent and laterally outward of said depending sidewall thereof and engaging said top annular surface of said cylindrical sidewall of said fill tube in sealing relation upon closure of said cap to provide further sealing.

15. A marine outboard drive unit having a two-cycle internal combustion engine, an oil storage tank mounted to said outboard drive unit and storing lubricating oil for said engine, a fill tube mounted to said outboard drive unit and communicating with said oil tank for filling same, said fill tube having an upper cap for closing same, said fill tube having an upper hinge pivotally mounting said cap thereto, and having a cantilever tab extending therefrom adjacent the hinged end of said cap and deflected during pivoting movement of said cap to provide a tactile feel and to resiliently retain said cap in a given open position.

16. The invention according to claim 15 wherein said cantilever tab has a resistance to deflection which is overcome during pivoting movement of said cap.

17. The invention according to claim 16 wherein said cantilever tab is nondeflected in said given open position of said cap and in the closed position of said cap.

18. The invention according to claim 17 wherein said cantilever tab is nonengaged by said cap in said closed position.

19. The invention according to claim 15 wherein said cantilever tab has an outer edge, and wherein said cap has a stop shoulder surface engaging said outer edge of said cantilever tab in said given open position to stop further pivoting movement of said cap and limit the travel thereof.

20. The invention according to claim 15 wherein said cap is hinged to said fill tube along a pivot axis, said cantilever tab extends laterally outwardly from said fill tube below said pivot axis, said cap has a camming surface extending from said pivot axis with an increased radius portion between reduced radius portions, one of said reduced radius portions facing said cantilever tab in said closed position of said cap, the other of said reduced radius portions facing said cantilever tab in said given open position of said cap, said intermediate increased radius portion engaging and cammingly deflecting said cantilever tab during pivoting movement of said cap between said closed and open positions.

21. A marine outboard drive unit having a two-cycle internal combustion engine, an oil storage tank mounted to said outboard drive unit and storing lubricating oil for said engine, a fill tube mounted to said outboard drive unit and comprising a lower tubular portion extending downwardly and communicating with said oil tank, an enlarged upper cup portion of greater diameter than said lower tubular portion to facilitate pouring of oil into said cup portion to flow downwardly through said lower tubular portion into said tank to fill the latter, said cup portion having a bottom wall and a generally cylindrical sidewall extending upwardly therefrom, said bottom wall having a first opening communicating with said lower tubular portion, said bottom wall having a second opening providing a vent opening, a hose connected between said tank and said vent opening and venting said tank to said cup portion of said fill tube, an inner dividing wall partitioning said cup portion into a first section communicating through said first opening with said lower tubular portion and a second section communicating with said vent opening, a cap closing said cup portion.

22. The invention according to claim 21 wherein said cap has a top wall and a cylindrical sidewall extending downwardly therefrom and engaging the interior surface of said cylindrical sidewall of said cup portion in sealing relation, said downwardly extending sidewall of said cap having an annular bottom surface, and wherein at least a portion of said annular bottom surface of said sidewall of said cap is spaced above said inner dividing wall in said cup portion and provides clearance for communicating between said first and second sections in said cup portion.

23. The invention according to claim 22 wherein said annular bottom surface of said sidewall of said cap has a notch therein above said inner dividing wall in said cup portion.

24. The invention according to claim 21 wherein said cap is hinged at one side to an external surface of said sidewall of said cup portion and has a distally opposite side with a snap lock closure engaging the opposite external surface of said sidewall to close said cup portion.

* * * * *